United States Patent [19]

Nakazato et al.

[11] 4,075,850

[45] Feb. 28, 1978

[54] STRIKING TOOL

[75] Inventors: Takashi Nakazato, Malbashi; Chikamitsu Sewada, Takasaki; Shigeyuki Umino, Maebashi; Mitsuhiro Takatsuru, Takasaki, all of Japan

[73] Assignee: Max Co., Ltd., Tokyo, Japan

[21] Appl. No.: 634,185

[22] Filed: Nov. 21, 1975

[30] Foreign Application Priority Data

Jun. 7, 1975 Japan ..... 50-73602
Jun. 28, 1975 Japan ..... 50-90824[U]

[51] Int. Cl.[2] ..... F01B 29/08; B25C 1/08

[52] U.S. Cl. ..... 60/633; 60/637; 173/116; 227/10

[58] Field of Search ..... 60/633, 638, 712, 637, 60/39.6; 227/9, 10; 173/116

[56] References Cited

U.S. PATENT DOCUMENTS

| | | | |
|---|---|---|---|
| 3,046,737 | 7/1962 | Ottestad | 60/39.6 |
| 3,320,740 | 5/1967 | Hawkins | 60/633 |
| 3,381,672 | 5/1968 | Tobias et al. | 227/10 |
| 3,576,103 | 4/1971 | Kahn | 60/633 |
| 3,729,927 | 5/1973 | Graves | 60/39.6 |
| 3,850,359 | 11/1974 | Obergfell | 227/10 |
| 3,933,290 | 1/1976 | Maier | 227/9 |

*Primary Examiner*—Charles J. Myhre
*Assistant Examiner*—Ira. S. Lazarus

[57] ABSTRACT

This striking tool of an internal combustion type includes in a housing of a tool body a cylinder providing slidably a piston connecting to a driver. A combustion chamber is disposed around the side wall of the cylinder. A fluid controlled valve is disposed between the combustion chamber disposed around the side wall of the cylinder. A fluid controlled valve is disposed between the combustion chamber and a piston upper chamber of the cylinder, which is normally biased to close communication between the combustion chamber and the piston upper chamber and operated to open communication therebetween when mixture gas of combustible gas and air in the combustion chamber is exploded therein. When a trigger, disposed on the external of the tool body and driveable outwardly, is driven, said mixture gas at first enters and fills up the combustion chamber and then is ignited therein by igniting means. A rising of combustion pressure generated by ignition of mixture gas in the combustion chamber directly opens said valve. The combustion pressure is, thereby, supplied into the piston upper chamber of the cylinder and pressurize a upper surface of the piston to drive the piston lower abruptly. At the same time, the piston gives the driver connected thereto striking force.

10 Claims, 7 Drawing Figures

STRIKING TOOL

DETAILED DESCRIPTION OF THE INVENTION

This invention relates to a striking tool which adopts a combustion pressure of mixture gas, and more particularly to a nailing machine, a cutting machine, a compressor, a pipe bender, a gun of an internal combustion type or the like.

As to an auto-nailing machine which is one of striking tools of this type, a tool adopting a compression force of compression spring and a pressure of a compressed air as a striking motor is well known.

In the case of the former, which adopts a spring, a spring force is accumulated when compressing said spring by a catching force of an operator. Accordingly, it is so difficult to generate too large a force by the limit of a catching force of an operator.

In the case of the latter which adopts a pressure of compressed air, a cost of an appratus including a compressed air source increases, and the tool has some disadvantages in operativity and portability.

These inventors have provided the auto-nailing machine having a large striking force and adopting an explosion pressure of combustible gas such as propane gas (Japanese patent publication number Showa 43-17353). Prior to a description about this invention, we illustrate the abstract of said auto-nailing machine referring to FIG. 1. In FIG. 1 a referring numeral 1 shows a cylinder slidably mounting a piston therein in air sealing. The piston 2 provides a piston rod continuously at the end portion thereof striking a nail in holder 4 into hard and dense material through a single stroke of said piston 2. The end portion of said piston rod forms a nail striking end portion. In the piston upper chamber 1a, an admission port 6 for combustible compressed gas, and admission port 7 for compressed air and an exhaustion port 8 for combustion gas which are selectably controlled through each valve (not shown). And a combustion chamber in which an ignition means 9 is disposed is defined therein. The cylinder 1 includes a restoring spring 10 driving a piston 2 to an upper portion of cylinder 1 in FIG. 1. By the above mechanism, combustible compressed gas and air is at first admitted into a piston upper chamber 1*a* to form combustible mixture gas thereof. Combustible mixture gas is ignited by means of igniter 9 to be exposed in the piston upper chamber 1*a*. The piston 2 abruptly drops down through a force evolved by explosion. The above-mentioned auto-nailing machine has the following fatal disadvantage that the pressure of admitted combustible mixture gas starts dropping down a piston 2 before combustible mixture gas is subjected to explosion. Because the piston upper chamber 1*a* forms a combustible chamber at the same time as mentioned above. Accordingly, the pressure of admitted combustible mixture gas is unable to be maintained in high enough to avoid dropping of combustion rate.

This invention has been developed to provide a striking tools of an internal combustion satisfying desired performances thereof over coming disadvantages pertained to the former striking tools. Accordingly, one object of the present invention is to provide a striking tool of an internal combustion type entirely changing explosion energy of combustible mixture gas to effective striking force.

Another object is to provide a striking tool of an internal combustion type having enough high rate of combustion.

A further object is to provide a striking tool of an internal combustion type having a concise structure, a small size and a large power.

A further object is to provide a strking tool of an internal combustion type in which the rising of a pressure of combustion gas safely, reliably and rapidly pressurize a piston for driving a driver.

A further object is to provide a striking tool of an internal combustion type in which a mixture ratio of combustible gas and compressed air is easily and precisely obtained.

A further object is to provide a striking tool of an internal combustion type having a combustion chamber which is separated to a piston upper chamber of a cylinder and disposed around a side wall of a cylinder.

A further object is to provide a striking tool of an internal combustion type having a valve which opens communication between a piston upper chamber of a cylinder and a combustion chamber only when explosion is performed and closing communication therebetween.

A further object is to provide a striking tool of an internal combustion type in which an auto-scavenging and exhausting of a combustion chamber is performed in connection with an opening communication between a piston upper chamber of a cylinder and a combustion chamber disposed around a side wall of cylinder when explosion is performed.

A further object is to provide a striking tool of an internal combustion type in which combustible mixture gas having appropriate mixture ratio is admitted into a combustion chamber by a diameter difference between a diameter of an admission way for compressed air and that of an admission way for combustible gas.

A further object is to provide a strking tool of an internal combustion type in which a piston for driving a driver is returned by means of an explosion pressure of combustible mixture gas.

A further object is to provide a striking tool of an internal type including auto-regulator which automatically adjusts a pressure of combustible gas on the basis of that of compressed air when combustible mixture gas is admitted into a combustion chamber.

A further object is to provide a striking tool of an internal type in which handling member operated outwardly to a tool body such as a trigger is driven to first admit combustible mixture gas having an appropriate mixture ratio into a combustion chamber, to second ignite the combustible mixture gas to explosion, to pressurize a piston for driving a driver by an explosion pressure to drop rapidly said piston down, at the same time, to release a backpressure of said piston and then to pressurize said explosion pressure on the piston lower chamber to return said piston and then to scavenge and exhaust combustion gas in a combustion chamber become clear automatically in a stroke of said piston.

Further objects and advantages appears from the following illustration claims and the attached drawings.

Figure 1:
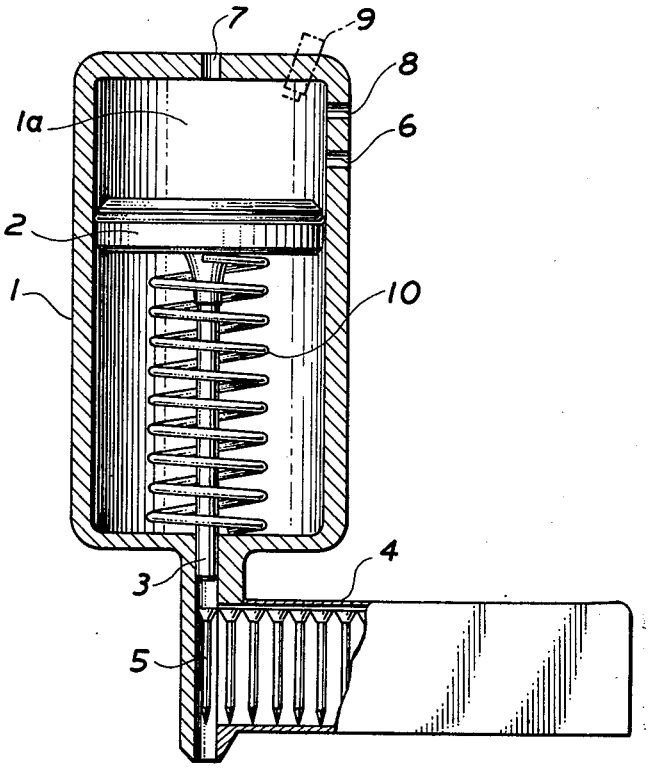
FIG. 1 is an auto nailing machine.

Referring now to the drawings attached to the present specification, suitable embodiments of the present invention is illustrated below. The attached Figures illustrate an embodiment in which the spirit of the present invention is applied to an auto-nailing machine. The spirit of the present invention should be understood not to be precisely limited to the following embodiment but naturally includes another modifications in the scope of the present invention.

FIG. 2 to FIG. 7 are longitudinal sectional views illustrating the main constructure of an auto-nailing machine to which the present invention is applied. FIG. 2 to FIG. 7 successively indicates working conditions which are different from each other in accordance with the order of working.

Figure 6:
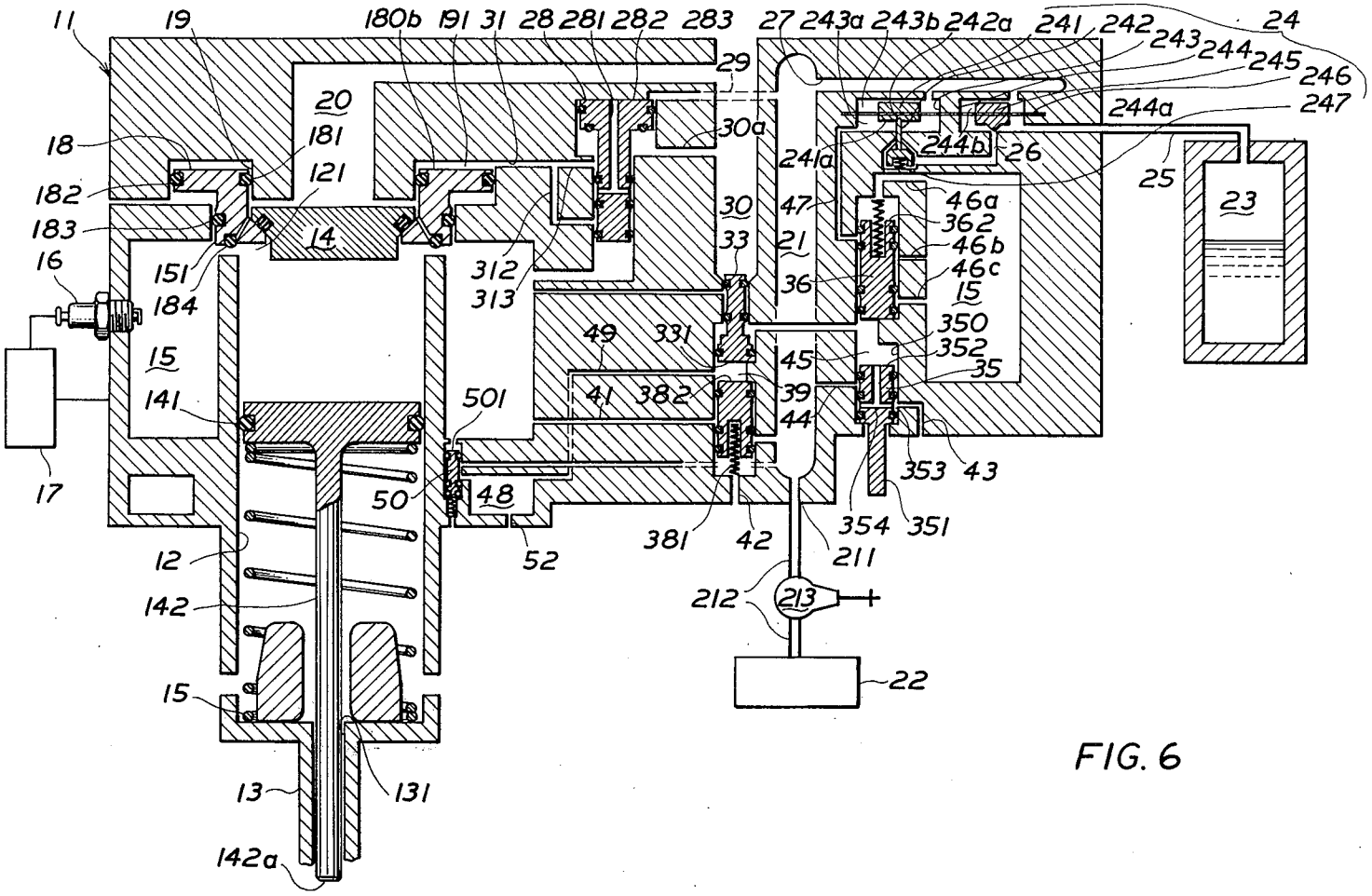

Firstly, an outline of the constructure will be illustrated referring to FIG. 2 to FIG. 7. In the FIGS. a portion indicated by numeral 11 is a housing forming a tool body. A portion indicated by a numeral 12 is a main cylinder and solidly, defined in the housing 11. From a lower end portion of the cylinder 12, a nozzle 13 through which a nail (not shown) is driven out extends. The nozzle 13 provides a nail supplying and charging mechanism through a nail magazine member. But said mechanism is herein not illustrated because it has no direct relation to the spirit of the present invention. For a nail supplying and charging mechanism, hitherto well known supplying mechanism may be adopted. A portion indicated by a numeral 14 is a main piston for driving a driver which is fitted with O ring 141 at an external side wall thereof. The piston 14 is slidably mounted in the cylinder 12 and sealed therein by said O ring 141. In accordance with the embodiment illustrated in the Figures, the piston 14 provides a restoring spring 15 under the lower surface and is normally held up at the upper dead center in the cylinder 12 by restoring force of the spring 15. Further, the piston 14 is solidly furnished with a driver 142 directly striking a nail. The driver 142 enters and exists a nozzle opening 131 defined in the nozzle 13 in accordance with movement of the piston 14. The tip portion, namely, a lower end portion 142*a* in the Figures forms an impact surface between a head of a nail (not shown) and the tip portion, namely, a nail striking end portion. A portion indicated by a numeral 15 is a combustion chamber which is defined around a side wall of said cylinder 12. The combustion chamber 15 defines an opening 151 connected to the piston upper chamber 121 at the upper end portion of an internal wall of said chamber 15 as shown in FIG. 6 and provides an igniter 16 such as an electric plug which is connected to an electric power supply such as a piezoelectric element 17. The piezoelectric element 17 is struck in connection with a trigger (not shown) for operating a trigger valve lately illustrated. The member indicated by a numeral 18 is a head valve body and slidably sealed in a head valve cylinder 19. Head valve body 18 which is disposed at the upper end portion of said cylinder 12 is furnished with O rings 181,182,183 and 184 and opens and shuts communication between the combustion chamber 15 and the piston upper chamber 121 or that between an exhaustion opening 23 and the piston upper chamber 121. A portion indicated by a numeral 21 is an air chamber which is connected to a compressed air source 22 such as an air compressor through a port 211 disposed at the external end portion of the housing 11 and a tube 212 midway providing an opening and shutting valve 213. A portion indicated by a numeral 23 is a combustible gas source such as LPG gas bomb which may be received in a bomb chamber (not shown) defined in the housing 11 or may be prepared separated from a tool body. A portion indicated by numerals 241 to 247 consists of an auto-regulator assembly 24. The members 241 and 245 is held by a diaphram 246 which defines the upper chamber 243 and the lower chamber 244. Against the lower surface 241*a* of the member 241, the upper end portion 242*a* of a valve member 242 is pressed. The other member 245 performs a valuing working. A spring member 247 normally biases up the above member 241. A portion indicated by a numeral 25 is a communication way disposed between the combustible gas source 23 and the diaphram lower chamber 244*a* of the chamber 244. A portion indicated by a numeral 26 is a communication way disposed between the diaphram lower chamber 244*a* and the other diaphram lower chamber 243*a*. Further, a diaphram upper chamber 243*b* of the chamber 243 and a diaphram upper chamber 244*b* of the chamber 244 is communicated to the air chamber 21 through a communication way 27. A member indicated by a numeral 28 is a release valve having an opening 281 communicated from an upper surface 282 to a middle portion of a side wall 283. The release valve 28 is provided at the middle portion of a communication way 29 to the air chamber 21, a communication way 30*a* to air, communication ways 31,311 and 312 to the head valve upper chamber 191 and a communication way 32 to the combustion chamber 15. A member indicated by a numeral 33 is a exhaustion valve which is provided at the middle portion of a communication way 34 to an exhaustion opening 30 and the combustion chamber 15, a communication way 37 between a pilot valve 35 lately illustrated and a feed valve 36, and a communication way 39 to a scavenging valve 38 lately illustrated. The scavenging valve 38 is provided at the middle portion of a communication way 40 therefrom to the air chamber 21, a communication way 41 therefrom to the combustion chamber 15 and said communication way 39, and biased upwardly by a spring 381. A portion indicated by a numeral 42 is a communication way opening out in air. A lower end portion 351 of a pilot valve 35 extends from the housing 11 and is pushed up by a trigger and the like (not shown).

The valve 35 is provided with an opening 354 communicated from an upper surface 352 to a side wall 353 and disposed at the middle portion of a communication way 43 to air, a communication way 44 to the air chamber 21, a communication way 45 to the feed valve 36, communication ways 46*a*, 46*b* and 46*c* to the combustion chamber 15, a communication way 47 to said chamber 243*a* and said communication way 45. Further, the valve 36 is downwardly biased by a spring 361. A portion indicated by a numeral 48 is an air chamber for exhaustion and scavenging, and a communicated to said communication way 39 through a communication way 49. A member indicated by a numeral 50 is a sensing valve of which the upper end portion is exposed in a combustion chamber 15 and of which the lower end portion is furnished with a spring 51 to be upwardly biased normally. The valve 50 senses a pressure rising of the combustion chamber 15 to selectably open or shut communication between the chamber 21 and the chamber 48. A numeral 51 indicates a communication way between the valve 50 and the air chamber 21, and a numeral 51 a small cavity connecting the chamber 48 to air. The actions relative to constructure members of the above-mentioned auto-nailing machine will be illustrated below. The opening and shutting valve 213 is now biased to an open position.

Figure 2:
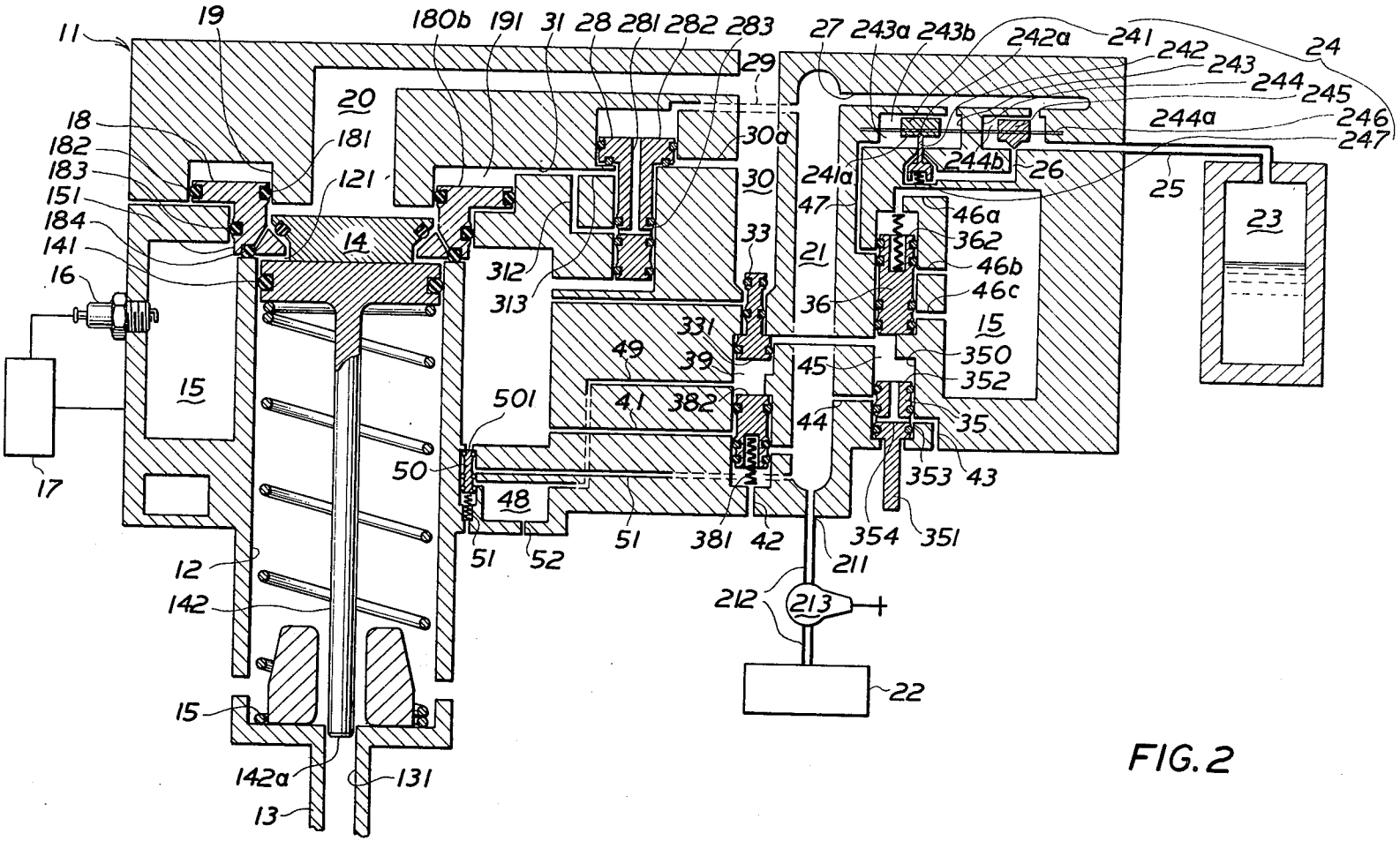
FIGS. 2–7 are sectional views illustrating the main construction of an auto nailing machine of the present invention.

Firstly, in no-operation of the machine, the members maintain a relation, thereof, indicated in FIG. 2. At this time, a driving member outwardly operated such as a trigger (not shown) is not yet driven. Accordingly, the pilot valve 35 occupies a position of a bottom dead center in the valve cylinder 350. The diaphram upper chambers 243*b*, 244*b* are supplied with compressed air through the air chamber 21. The upper surface 282 of release valve and the head valve upper chamber 191 is supplied with compressed air to give them a pressure thereof. Thereby, the release valve body 28 occupies a position of a bottom dead center to communicate the valve upper chamber 191 to the air chamber 21. The head valve body 18 occupies a position of a bottom dead center to push down the O ring 184 thereof against the head portion 123. The valve body 18 thereby maintains shutting communication between the piston upper chamber 121 of the main cylinder 12 and the combustion chamber 15, at the same time, communicating said chamber 121 to air. Accordingly, the main piston 14 maintains pushed up to the top dead center by the spring 15. The sensing valve 50 maintains pushed up to the top dead center by the spring 51. The scavenging valve body 38 maintains pushed up to the top dead center by the spring 381. The exhaustion valve body 33 occupies the top dead center. The feed valve body 36 maintains pushed down to the bottom dead center by the spring 361. A nail (not shown) has been charged in the nozzle opening 131 defined in the nozzle 13 under the conditions above-mentioned.

Figure 3:
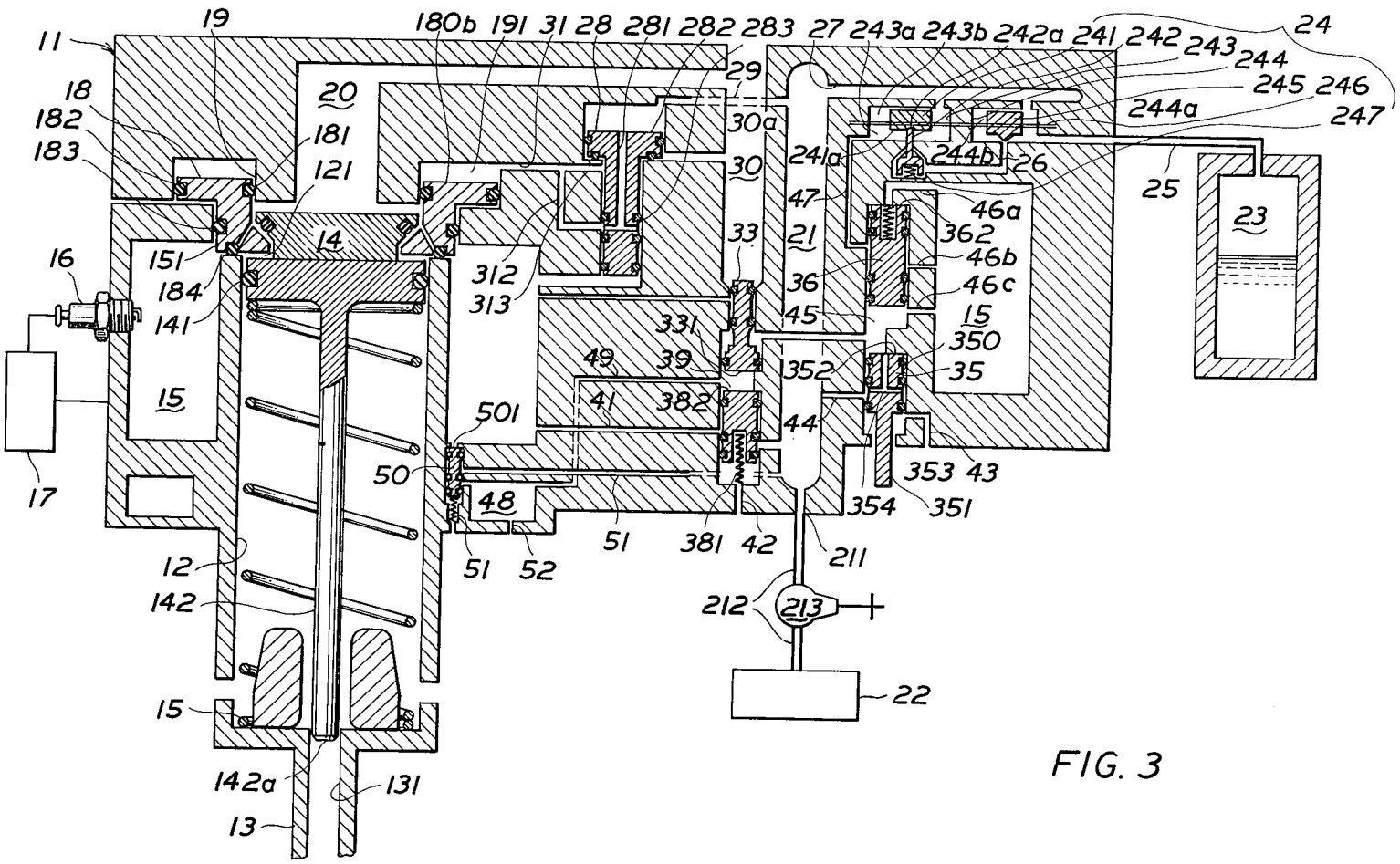
Figure 4:
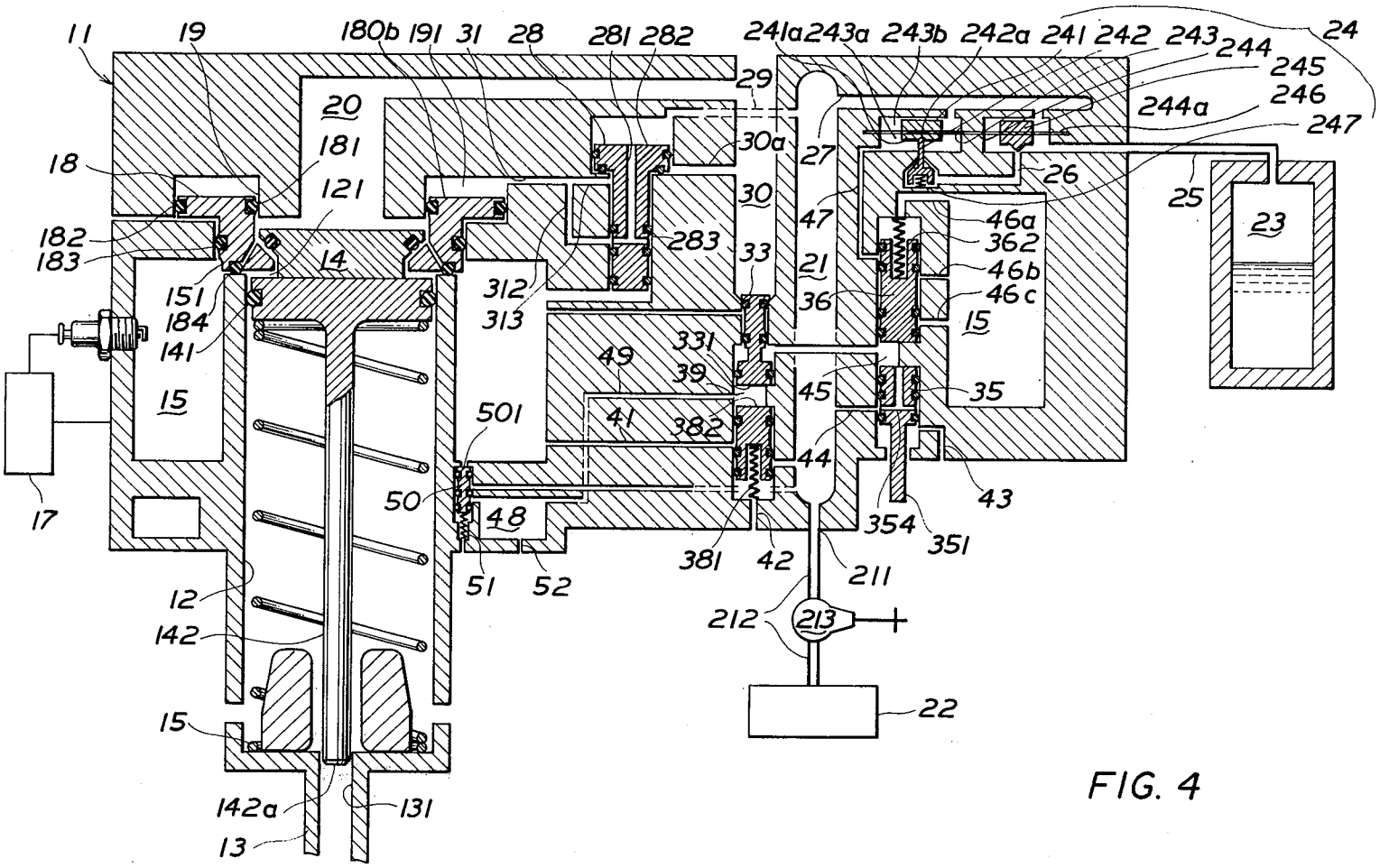
Figure 5:
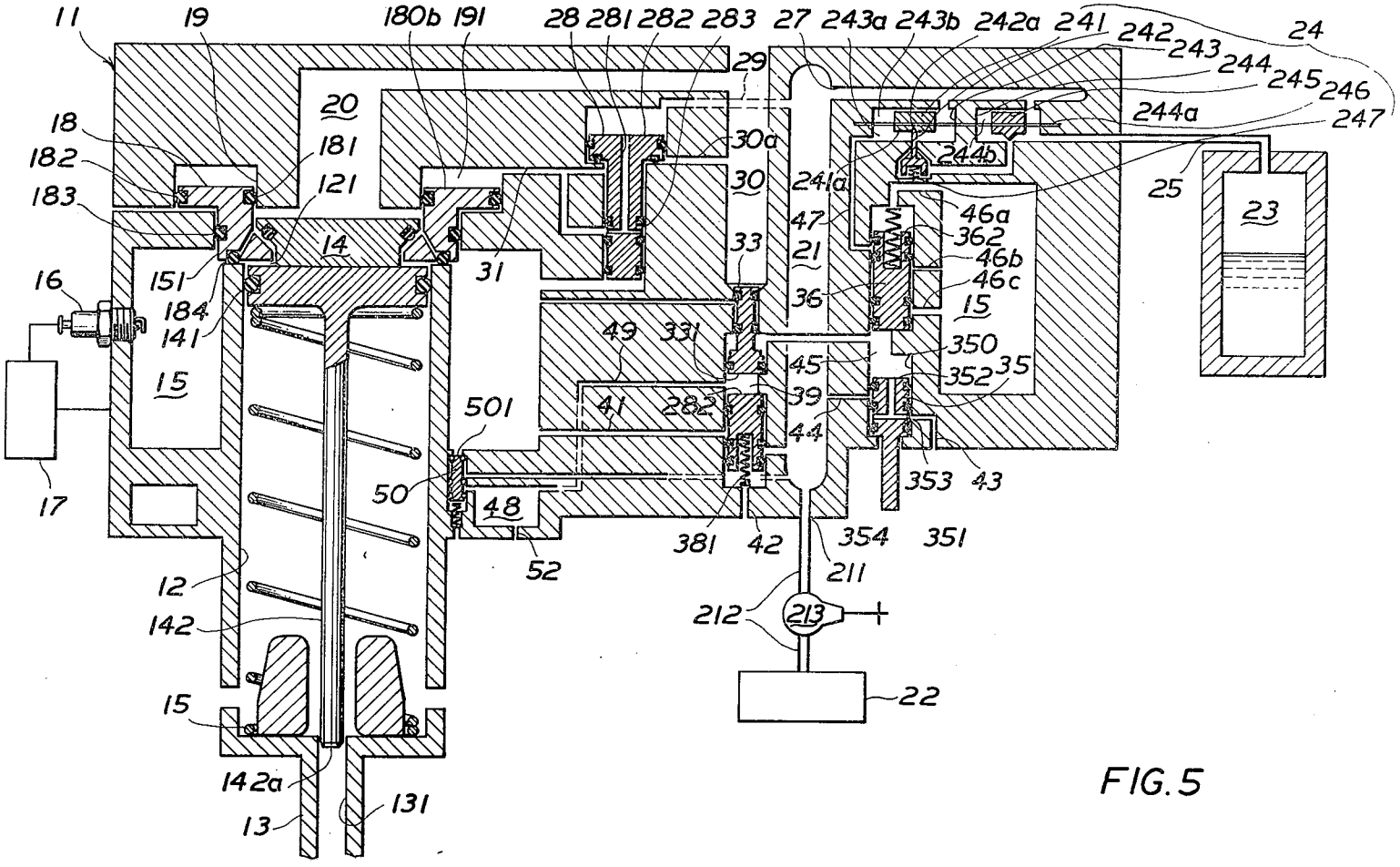

Secondly, a trigger (not shown) is pulled up to shift relations of constructure members illustrated in FIG. 2 to that illustrated in FIG. 3. The pilot valve body 35 is pushed up to the top dead center to form an air admission way consisting of the air chamber 21, a communication way 44, an opening 354, a communication way 45 and a communication way 37. Thereby, an exhaustion valve body 33 is pushed up to the top dead center to shut communication between the communication way 34 and the exhaustion port 30. At the same time, the feed valve body 36 receives compressed air at the side of the communications way 45 to be shifted up to the top dead center. When the feed valve body 36 reaches to the top dead center, an admission way for combustible gas which consists of the communication ways 47 and 46*b* and an admission way for compressed air which consists of the communication ways 45 and 46*c*. The diameter of the communication way 46*c* is larger than that of the communication way 46*b* so that combustible gas and compressed air is admitted into the combustion chamber in accordance with the diameter difference thereof. The pressure of combustible gas is adjusted by the auto-regulator 24 on the basis of that of compressed air. Particularly, combustible gas of higher pressure than that of compressed air is admitted into the chamber 244 a to shift up the member 245 and to communicate the communication way 25 to the communication way 26. The communication way 26 and 47 are communicated only when the total force of the pressure of combustible gas in the chamber 243 a and the restoring force of the spring 247 becomes equal to the pressure of compressed air. In other words, the pressure of combustible gas is adjusted at the low level equal to that of compressed air minus the restoring force of the spring 247. As illustrated above, the combustion chamber 15 is filled up with combustible mixture gas having desired mixture ratio to equally pressurize the pressure of said mixture gas to the upper 362 and lower surface 363 of the feed valve body 36. Because the feed valve body 36 is downwardly biased by the spring 361 disposed on the upper surface 362, the valve body 36 is pushed down to the bottom dead center by the restoring force of the spring 361 as shown in FIG. 4. Combustible mixture gas is sealed in the combustion chamber 15 under the conditions shown in FIG. 4. At this time, the sensing valve body 50 maintains shifted up to the top dead center by the restoring force of the spring 51 larger than the pressure of combustible mixture gas. The head valve body 18 too maintains a condition shown in FIG. 2, 3, because the area of the upper surface 180*b* is enough larger than that of the lower surface 180*a*, though it receives a pressure of combustible mixture gas at the surface of the lower end portion 180*a*.

When the condition shown in FIG. 4 has finished, a trigger (not shown) is ruther driven, really an instant continuous operation, to strike a piezoelectric element with the result of ignition by the igniter 16. Thereby combustible mixture gas admitted in the combustion chamber 15 is ignited at the same time. The rising of the combustion pressure in the combustion chamber shifts the release valve body 28 up to the top dead center in reception of the combustion pressure at the surface of the lower end portion 284 as shown in FIG. 6. At the same time or before the condition of the mechanism is shifted to that shown in FIG. 6, the pilot valve body 35 is shifted down from the top dead center shown in FIG. 4 to the bottom dead center shown in FIG. 5 to communicate the communication way 37 and communication way 45 to air.

As shown in FIG. 6, the release valve body 28 is shifted up to the top dead center to communicate the head valve upper chamber 191 through communication ways 31, 311 and 30*a* to the exhaustion port 30 opening in air. Accordingly, the head valve body 18 is pushed up to the top dead center by the combustion pressure received at the lower end surface 180*a*. In accordance with the condition shown in FIG. 6, the combustion chamber 15 is communicated to the piston upper chamber 121 of the main cylinder 12 through the opening 151. Thereby, the main piston 14 receives a combustion pressure to rapidly drop down in the main cylinder 12, and the driver 142 solidly connected to said piston 14 strikes out a nail (not shown) charged in the nozzle opening.

The striking operation of a nail is finished when the piston 14 reaches the bottom dead center in the main cylinder 12.

Figure 7:
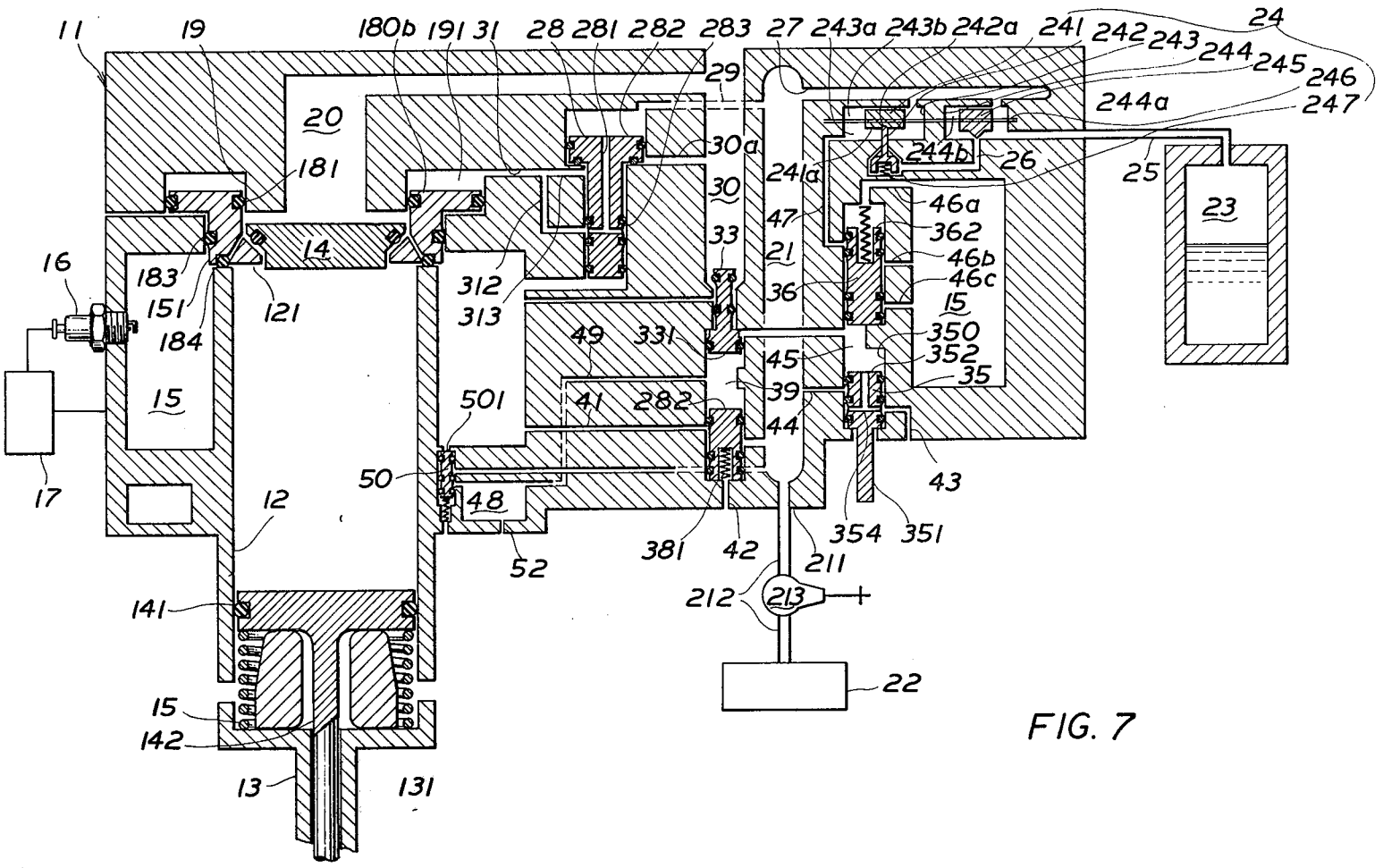

At the same time when combustible mixture gas is explosed in the combustion chamber 15, the upper end surface 501 of the sensing valve body 50 exposed in the combustion chamber 15 is pushed down by the combustion pressure to the bottom dead center against the restoring force of the spring 51. Thereby, the valve body 50 defines an air admission way of the air chamber 21, the communication way 51 and the chamber 48 to admit compressed air into said chamber 48. Because the chamber 48 is through the communication way 49 communicated to the communication way 39, and increases a capacity at the middle portion of communication ways 51, 49, and is provided with the small cavity 52 opening in air, the time through which compressed air reaches from the communication way 39 to the lower surface 331 of the exhaustion valve body 33 at the same time, the upper surface of the scavenging valve body 38 is delayed. The delay time is determined by the capacity of the chamber 48 and the diameter of the small cavity 52. As shown in FIG. 7, when compression air is admitted into the communication way 39 through the chamber 48, the exhaustion valve body 33 is shifted up to the top dead center receiving the pressure at the lower end surface 331 to communicate the communication way 34 to the exhaustion port 30. At the same time, the scavenging valve body 38 is shifted down to the bottom dead center against the restoring force of the spring 381 receiving the pressure at the upper end surface 382 to communicate the communication ways 40 and 41. Namely, under the condition shown in FIG. 7, compressed air in the air chamber 21 is admitted into the combustion chamber 15 through the communication way 40, the scavenging valve body 38 and the communication way 41 and is exhausted from the combustion chamber 15 to the exhaustion port through the communication way 34 and the exhaustion valve 33. Accordingly, the combustion chamber 15 is cleared in a passage of clean compressed air to exhaust and scavenge the remained combustion gas therein. The above exhaustion and scavenging is continued only when compressed air is admitted from the chamber 48 to the communication way 39. In other words, when compressed air in the chamber 48 runs away in air through the small cavity 52 to drop down the air pressure in the communication way 39 equal to 1 atmospheric pressure, the exhaustion valve body 38 is pushed up to the top dead center by the restoring force of the spring 381 to shut off communication between the communication ways 40, 41 and to stop the admission of compressed air from the air chamber 21 to the combustion chamber 15. The above-illustrated striking tools of an internal combustion type finish the workings to an admission of combustible mixture gas into the combustion chamber, explosion thereof, a nail striking and exhaustion and scavenging in a stroke to recover the initial step shown in FIG. 2. Thereby, an operative member such as a trigger (not shown) is driven to push up the pilot valve body 35 and thereby the above steps is repeated continuously to strike the following nail. As illustrated above, the main cylinder 12 is disposed separated to the combustion chamber 15 and only when an explosion is caused, the valve 18 opens communcation between said cylinder 12 and said chamber 15.

In accordance with the present invention, a higher efficiency of combustion is attained because the pressure of combustible mixture gas is maintained adequately prior to an explosion thereof by the valve 18.

Further, a disadvantage that combustible mixture gas and incomplete combustion gas are directly admitted into the main cylinder in the condition of inadequate rising of internal pressure of the combustion chamber 15 at the time of miss-ignition or incomplete combustion because the valve 18 opens in connection with the pressure rising in the combustion chamber 15.

Further, combustible mixture gas housing an adequate mixture ratio is easily, reliably admitted because the combustion chamber 15 is exhausted in connection with the explosion of combustible mixture gas and the pressure of combustible mixture gas is adequately adjusted on the basis of the pressure of compressed air.

We claim:

1. A striking tool of an internal combustion type comprising a valve opening communication between a piston upper chamber of a cylinder, which is assembled in a housing and slidably provides a piston for driving a driver and a combustion chamber disposed around a side wall of said cylinder when an explosion is generated in said combustion chamber.

2. A striking tool of an internal combustion type comprising a head valve disposed between a piston upper chamber of a cylinder which is assembled in a housing and slidable provides a piston for driving a driver and a combustion chamber disposed around a side wall of said cylinder normally opening communcation between said piston upper chamber and air, at the same time, normally closing communication between said piston upper chamber and said combustion chamber and when an explosion is generated in said combustion chamber, closing communication between said piston upper chamber and air, at the same time, opening communication between said piston upper chamber and said combustion chamber.

3. A striking tool of an internal combustion type comprising a sensing means of which a pressure receiving end portion is exposed to a combustion chamber disposed around a side wall of cylinder which is assembled in a housing and slidably provides a piston for driving a driver, sensing a rising of a pressure in said combustion chamber to generate a sensing signal thereof, thereby opening communication between a piston upper chamber of said cylinder and said combustion chamber, and supplying an explosion pressure to said piston upper chamber.

4. A striking tool of an internal combustion type claimed in claim 3 comprising a release valve as a pressure sensing means selectably opening communication between an upper chamber of a head valve and a compressed air source, or that between an air chamber for exhausting and scavenging combustion gas and said compressed air source.

5. A striking tool of an internal combustion type comprising a valve opening communication between a piston upper chamber of a cylinder which is assembled in a housing and slidably provides a piston for driving a driver and a combustion chamber disposed around a side wall of said cylinder when an explosion is generated in said combustion chamber, an admission way for compressed air connected to a compressed air source and feeding compressed air through a feed valve, an admission way for combustible gas connected to a combustible gas source feeding said combustible gas through another feed valve and gases mixing means through said two admission way supplying mixture gas of combustible gas and compressed air into said combustion chamber.

6. A striking tool of an internal combustion type claimed in claim 5 wherein a diameter of an admission way for compressed air is larger than that of an admission way for combustible gas.

7. A striking tool of an internal combustion type claimed in claim 5 wherein a feed valve supplies compressed air only from a compressed air source into the combustion chamber through an admission way for compressed air, another feed valve combustible gas from a combustible gas source into said combustion chamber through an admission way for combustible gas only when supplying said compressed air into combustion chamber.

8. A striking tool of an internal combustion type claimed in claim 5 comprising an admission way for combustible gas housing between a combustible gas source and a feed valve an auto-regulator which adjusts a pressure of combustible gas passing said admission way in direct ratio to a pressure of compressed air.

9. A striking tool of an internal combustion type comprising a valve opening communication between a piston upper chamber of a cylinder which is assembled in a housing and slidably provides a piston for driving a driver and a combustion chamber disposed around a side wall of said cylinder when an explosion is generated in said combustion chamber, and an exhausting and scavenging mechanism opening an admission port for compressed air and an exhaust port for combustion gas disposed at said combustion chamber throgh the first signal sensing the bottom dead center of said piston in said cylinder and closing said admission port for compressed air through the second signal delayed to said first signal.

10. A striking tool of an internal combustion type comprising a valve opening communication between a piston upper chamber of a cylinder which is assembled in a housing and slidably provides a piston for driving a driver and a combustion chamber disposed around a side wall of said cylinder when an explosion is generated in said combustion chamber, and another valve releasing a back-pressure of a piston lower chamber of a cylinder in a striking stroke and opening communication between said combustion chamber and said piston lower chamber through a signal sensing that said piston reaches to the bottom dead center, thereby an explosion pressure returning said piston.

* * * * *